US008893792B2

(12) United States Patent
Mazyar et al.

(10) Patent No.: US 8,893,792 B2
(45) Date of Patent: Nov. 25, 2014

(54) ENHANCING SWELLING RATE FOR SUBTERRANEAN PACKERS AND SCREENS

(75) Inventors: Oleg A. Mazyar, Houston, TX (US); Michael H. Johnson, Katy, TX (US); Keith J. Murphy, Simsbury, CT (US)

(73) Assignee: Baker Hughes Incorporated, Houston, TX (US)

( * ) Notice: Subject to any disclaimer, the term of this patent is extended or adjusted under 35 U.S.C. 154(b) by 452 days.

(21) Appl. No.: 13/249,613

(22) Filed: Sep. 30, 2011

(65) Prior Publication Data

US 2013/0081815 A1 Apr. 4, 2013

(51) Int. Cl.

| | |
|---|---|
| ***E21B 33/12*** | (2006.01) |
| ***E21B 23/06*** | (2006.01) |
| ***E21B 36/00*** | (2006.01) |

(52) U.S. Cl.

CPC ..... *E21B 23/06* (2013.01); *E21B 33/1208* (2013.01); *E21B 36/008* (2013.01)

USPC ..... 166/300; 166/387

(58) Field of Classification Search

CPC ..... E21B 23/06; E21B 33/12; E21B 2023/00

USPC ..... 166/300, 387, 179

See application file for complete search history.

(56) References Cited

U.S. PATENT DOCUMENTS

| | | | |
|---|---|---|---|
| 2,789,195 | A | 4/1957 | Hortvet |
| 3,716,101 | A | 2/1973 | McGowen, Jr. et al. |
| 4,017,414 | A | 4/1977 | Black et al. |
| 4,264,362 | A | 4/1981 | Sergev et al. |
| 4,515,213 | A | 5/1985 | Rogen et al. |
| 4,538,682 | A | 9/1985 | McManus et al. |
| 5,582,251 | A | 12/1996 | Bailey et al. |
| 6,278,095 | B1 | 8/2001 | Bass et al. |
| 6,278,096 | B1 | 8/2001 | Bass |
| 6,285,014 | B1 | 9/2001 | Beck et al. |
| 6,384,389 | B1 | 5/2002 | Spencer |
| 6,926,083 | B2 | 8/2005 | Larovere |
| 7,013,979 | B2 | 3/2006 | Richard |
| 7,104,317 | B2 | 9/2006 | Richard et al. |
| 7,152,657 | B2 | 12/2006 | Bosma et al. |
| 7,318,481 | B2 | 1/2008 | Richard |
| 7,441,596 | B2 | 10/2008 | Wood et al. |
| 7,552,768 | B2 | 6/2009 | O'Brien |

(Continued)

FOREIGN PATENT DOCUMENTS

| | | |
|---|---|---|
| CA | 1215642 | 12/1986 |
| CN | 2078793 | 6/1991 |

(Continued)

OTHER PUBLICATIONS

Aiyejina, A., et al.; "Wax Formation in Oil Pipelines: A Critical Review", Int. J. Multiphase Flow; 1-24, 2011.

(Continued)

*Primary Examiner* — Cathleen Hutchins

(74) *Attorney, Agent, or Firm* — Steve Rosenblatt

(57) ABSTRACT

The swelling rate of a swelling packer element or a conforming foam screen material is accelerated with heat. In one variation reactants that create an exothermic reaction plus a catalyst, if needed, are allowed to come into contact upon placement at the desired location. The heat accelerates the swelling process and cuts the time to when the next operation can commence downhole.

25 Claims, 5 Drawing Sheets

(56) References Cited

U.S. PATENT DOCUMENTS

| | | | | |
|---|---|---|---|---|
| 7,562,704 | B2 | 7/2009 | Wood et al. | |
| 7,597,152 | B2 | 10/2009 | Wood et al. | |
| 7,644,773 | B2 | 1/2010 | Richard | |
| 7,665,537 | B2 * | 2/2010 | Patel et al. | 166/387 |
| 7,681,653 | B2 | 3/2010 | Korte et al. | |
| 7,703,539 | B2 | 4/2010 | Levy | |
| 7,730,940 | B2 | 6/2010 | Knippa et al. | |
| 7,997,338 | B2 | 8/2011 | Foster et al. | |
| 8,187,252 | B2 | 5/2012 | Buckley et al. | |
| 2004/0060707 | A1 * | 4/2004 | Bearden et al. | 166/380 |
| 2007/0137826 | A1 | 6/2007 | Bosma et al. | |
| 2008/0110626 | A1 * | 5/2008 | Allison et al. | 166/288 |
| 2008/0264647 | A1 | 10/2008 | Li | |
| 2009/0151957 | A1 | 6/2009 | Sickle et al. | |
| 2009/0159278 | A1 | 6/2009 | Corre et al. | |
| 2009/0223678 | A1 | 9/2009 | Richard et al. | |
| 2010/0181080 | A1 | 7/2010 | Levy | |
| 2011/0120733 | A1 | 5/2011 | Vaidya et al. | |
| 2011/0132143 | A1 | 6/2011 | Xu et al. | |
| 2011/0132612 | A1 | 6/2011 | Agrawal et al. | |
| 2011/0132619 | A1 | 6/2011 | Agrawal et al. | |
| 2011/0132620 | A1 | 6/2011 | Agrawal et al. | |
| 2011/0132621 | A1 | 6/2011 | Agrawal et al. | |
| 2011/0135530 | A1 | 6/2011 | Xu et al. | |
| 2011/0135953 | A1 | 6/2011 | Xu et al. | |
| 2011/0136707 | A1 | 6/2011 | Xu et al. | |
| 2012/0024109 | A1 | 2/2012 | Xu et al. | |
| 2012/0031611 | A1 | 2/2012 | Xu et al. | |
| 2012/0103135 | A1 | 5/2012 | Xu et al. | |
| 2012/0107590 | A1 | 5/2012 | Xu et al. | |
| 2013/0150533 | A1 | 6/2013 | Budhlall et al. | |

FOREIGN PATENT DOCUMENTS

| | | |
|---|---|---|
| RU | 2188932 | 9/2002 |
| RU | 2198284 | 2/2003 |
| RU | 2284407 | 9/2006 |
| WO | 2007055592 | 5/2007 |
| WO | 2011039544 | 4/2011 |

OTHER PUBLICATIONS

Scarmento, R.C.; "Wax Blockage Removal by Inductive Heating of Subsea Pipelines"; Heat Transfer Engineering, 25(7); 2-12, 2004.

* cited by examiner

ENHANCING SWELLING RATE FOR SUBTERRANEAN PACKERS AND SCREENS

FIELD OF THE INVENTION

The field of the invention is subterranean tools that deploy by swelling and more particularly construction details and techniques that accelerate the swelling rate for faster deployment.

BACKGROUND OF THE INVENTION

Packers made of an element that swells in oil or water have been in use for some time as evidenced by U.S. Pat. Nos. 7,997,338; 7,562,704; 7,441,596; 7,552,768; 7,681,653; 7,730,940 and 7,597,152. These designs focus on construction techniques for faster deployment, mechanical compression assists to the swelling or enhancing the performance of an inflatable using an internal swelling material to enhance the seal, elimination of leak paths along the mandrel after swelling and running conduits through the swelling sealing element and still having a good seal.

Shape conforming screens that take the shape of open hole and act as screens have been disclosed using shape memory foam that is taken above its transition temperature so that the shape reverts to an original shape which is bigger than the surrounding open hole. This allows the foam to take the borehole shape and act effectively as a subterranean screen. Some examples of this are U.S. Pat. Nos. 7,013,979; 7,318,481 and 7,644,773. The foam used heat from surrounding wellbore fluids to cross its transition temperature and revert to a shape that let it conform to the borehole shape.

One problem with swelling materials is that the swelling rate can be very slow and that effective deployment requires the swelling to complete to a particular degree before subsequent tasks can commence at the subterranean location. What is known is that if there is more heat that the swelling to the desired configuration, so that subsequent operations can commence, can happen sooner rather than later. Since time has an associated cost, it has been an object to accelerate the swelling or reverting to a former shape process, depending on the material involved.

Various techniques have added heat with heaters run in on wireline or embedded in the packer itself and triggered from a surface location, or have used the heat from well fluid at the deployment location, or heat from a reaction to chemicals pumped to the deployment location, or induction heating of shape memory metals. Some examples are: U.S. Publication 2010/0181080; U.S. Pat. No. 7,703,539; U.S. Publication 2008/0264647; U.S. Publication 2009/0151957; U.S. Pat. No. 7,703,539; U.S. Pat. No. 7,152,657; U.S. Publication 2009/0159278; U.S. Pat. No. 4,515,213; U.S. Pat. No. 3,716,101; U.S. Publication 2007/0137826; CN2,078,793 U (steam injection to accelerate swelling); and U.S. Publication 2009/0223678. Other references have isolated reactants and a catalyst in composite tubulars that have not been polymerized so they are soft so that they can be coiled for deployment and upon deployment expansion of the tubular allows the reaction to take place to make the tubular string rigid. This is illustrated in U.S. Pat. No. 7,104,317.

Bringing together discrete materials downhole for a reaction between them is illustrated in U.S. Pat. No. 5,582,251.

The present invention seeks to accelerate swelling in packers and screens made of swelling material by a variety of techniques. One way is to embed reactants and, if necessary, a catalyst in the swelling material and allow the reaction to take place at the desired location to speed the swelling to conclusion. This generally involves a removal of a barrier between or among the reactants in a variety of ways to get the exothermic reaction going. Various techniques of barrier removal are described. The heat is given off internally to the swelling member where it can have the most direct effect at a lower installed cost.

Another heat addition alternative involves addition of metallic, preferably ferromagnetic particles or electrically conductive resins or polymers in the swelling material. Induction heating is used to generate heat at the particles or resin or polymer to again apply the heat within the element while taking up no space that is of any consequence to affect the ability of the packer to seal when swelling or the screen to exclude particles when the screen is against the borehole wall in an open hole, for example. Optionally the mandrel can be dielectric such as a composite material so that the bulk of the heating is the particles alone. Otherwise the mandrel itself can also be heated and transfer heat to the surrounding element. Induction heating of pipe is known for transfer of heat to surrounding cement as discussed in U.S. Pat. No. 6,926,083 but the rate of heat transfer is very much dependent on a temperature gradient from the pipe into the cement and is less effective than inductively heating the object that needs the heat directly as proposed by the present invention. Also relevant is U.S. Pat. No. 6,285,014 which heats casing with an induction heater lowered into the casing with the idea that the heated casing will transfer heat to the surrounding viscous oil and reduce its viscosity so that it can flow.

Those skilled in the art will better appreciate additional aspects of the invention by a review of the detailed description of the preferred embodiments and the associated drawings while recognizing that the full scope of the invention is to be determined by the appended claims.

SUMMARY OF THE INVENTION

The swelling rate of a swelling packer element or a conforming foam screen material is accelerated with heat. In one variation reactants that create an exothermic reaction plus a catalyst, if needed, are allowed to come into contact upon placement at the desired location. In another technique metallic, preferably ferromagnetic, particles or electrically conductive resins or polymers are interspersed in the swelling material and heat is generated at the particles by an inductive heater. A dielectric mandrel or base pipe can be used to focus the heating effect on the ferromagnetic particles or the electrically conductive resins or polymers in the sealing element or swelling foam screen element to focus the heating there without heating the base pipe. The heat accelerates the swelling process and cuts the time to when the next operation can commence downhole.

DETAILED DESCRIPTION OF THE PREFERRED EMBODIMENT

Figure 1:
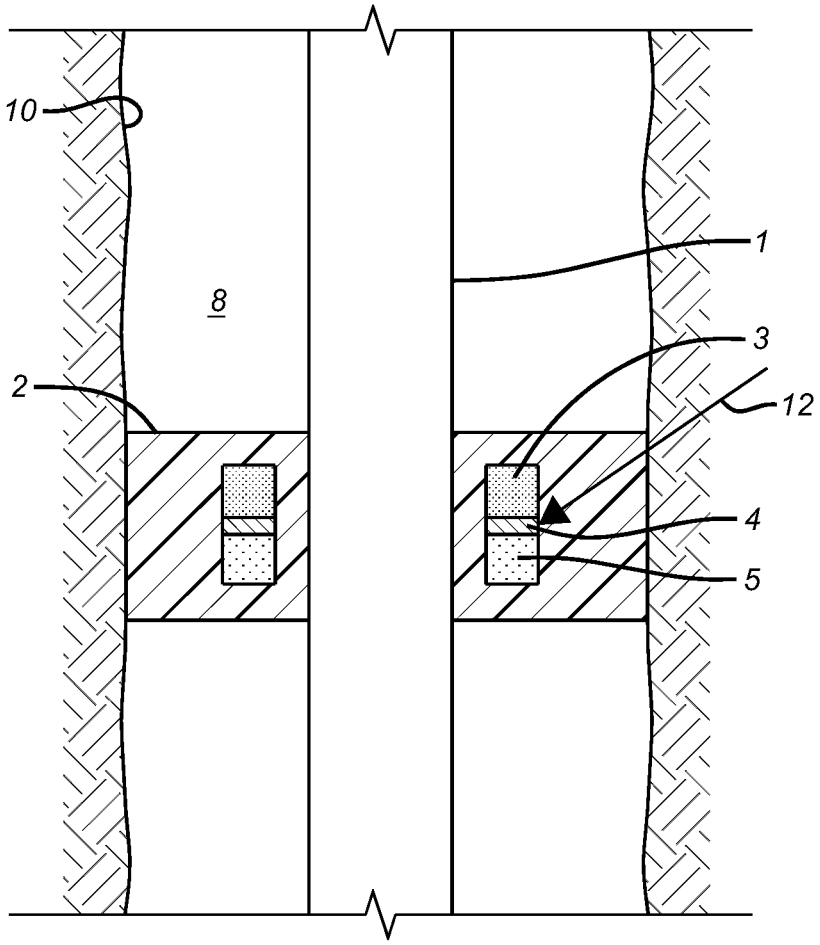
FIG. 1 is a schematic illustration of the embodiment where the reactants are held apart until they are allowed to mix and react to cause a release of heat to accelerate the swelling of the element.

Referring to FIG. 1, the mandrel 1 supports an element 2 that can be a swelling packer element or a porous screen material that swells. In either case the objective is to speed up the swelling process with the addition of heat so that the next operation at the subterranean location can take place without having to wait a long time for the swelling to have progressed to an acceptable level. FIG. 1 illustrates heat added directly into the element 2 as opposed to indirect ways that depend on thermal gradients for heat transfer such as using the temperature in the surrounding well fluids in the annulus 8 of the wellbore 10, which is preferably open hole but can also be cased or lined. Compartments 3 and 5 are separated by a barrier 4. The individual reactants and a catalyst, if needed, are stored in compartments 3 and 5. At the desired location or even on the way to the desired location the objective is to make the barrier fail or become porous or otherwise get out of the way of separating the reactants in the compartments 3 and 5 so that such reactants with a catalyst, if any, can come together for an exothermic reaction that will enhance the swelling rate of the element 2.

Arrow 12 schematically illustrates the variety of ways the barrier 4 can be compromised. One option is a depth actuation where one side of the barrier is sensitive to hydrostatic pressure in the annulus 8 and the other compartment is isolated from hydrostatic pressure in the annulus 8. Exposure to pressure in annulus 8 to say compartment 3 can be through a flexible membrane or bellows that keeps well fluid separate from a reactant in compartment 3. At a given depth the annulus pressure communicating through compartment 3 and into the barrier 4 puts a differential pressure on the barrier to cause it to fail allowing compartments 3 and 5 to communicate and the exothermic reaction to start. Another variation on this if the annulus pressure is too low is to pressurize the annulus 8 when it is desired to start the reaction and the rest takes place as explained above when relying on hydrostatic in the annulus 8.

Another way is to use a timer connected to a valve actuator that when opened allows well fluid to get to the barrier 4 and either melt, dissolve or otherwise fail the barrier 4. The power for the timer and the actuator can be a battery located in the element 2.

Another way is to rely on the expected temperature of well fluid to permeate the element 2 and cause the barrier 4 to melt or otherwise degrade from heat from the well fluids.

Figure 3:
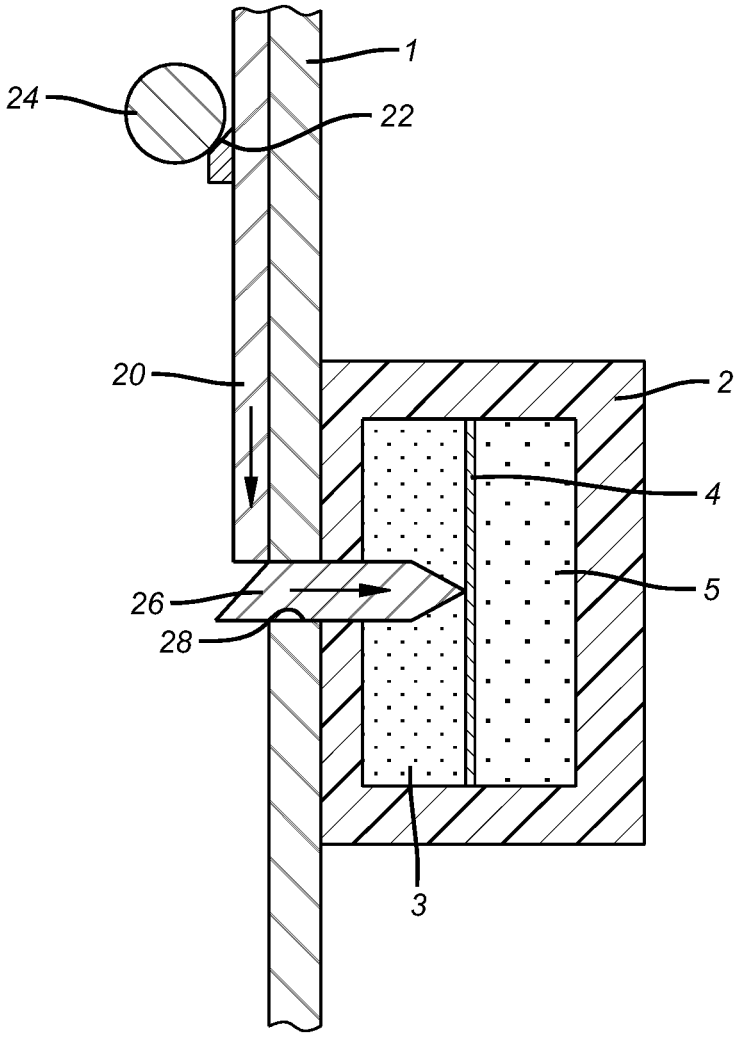
FIG. 3 shows the barrier between reactants broken with a shifting sleeve extending a knife.

FIG. 3 illustrates the compartments 3 and 5 separated by the barrier 4 located within the element 2 that is mounted to the mandrel or base pipe 1. A sleeve 20 has a ball seat 22 that accepts a ball 24. Pressure from above on the ball shifts the sleeve 20 and force knife 26 to move radially to penetrate the barrier 4. Note that the knife 26 moves through a wall opening 28. Alternatively the knife 26 can be induced to move axially to slice through the barrier 4 using a physical force as described above or equivalent physical force or by using an indirect force such as a magnetic field. If the operator finds the use of a wall opening 28 unacceptable in a swelling packer application then the knife can be magnetized and located within compartment 3 and a magnet can be delivered to the location of the element 2 so that the repulsion of the two magnets can advance the knife 26 axially or radially through the barrier 4. If the element 2 is a porous screen the tubular 1 will be perforated under the element 2 so that an opening 28 for the knife 26 should be of no consequence for the operator.

Another variation is to use galvanic corrosion using one or more electrodes associated with the barrier 4. In run in mode an electrode can be energized to prevent the onset of corrosion and ultimate failure of barrier 4, while in another mode the corrosion can be initiated using the same electrode or another electrode associated with the barrier 4. The process can be actuated from the surface or in other ways such as by time, pressure or temperature triggers to initiate the corrosion process. Alternatively, the barrier 4, itself can be the sacrificial member of a galvanic pair and just corrode over time. Alternatively a corrosive material can be stored in a pressurized chamber with a valve controlled by a processor to operate a valve actuator to allow the corrosive material to reach the barrier 4 and degrade the barrier to start the exothermic reaction.

Another alternative is to use at least one reactant that over time will attack the barrier 4 and undermine it.

Figure 5:
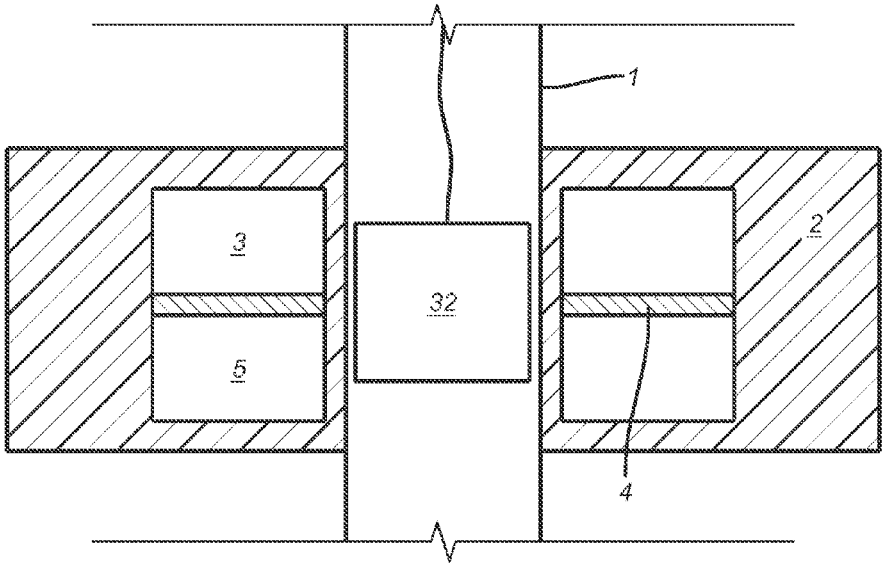
FIG. 5 illustrates the use of a corrodible conductive barrier whose failure is accelerated with inductive heating.

In another variation, one compartment contains a reactant corrosive to the barrier 4, for example NaCl aqueous solution or seawater. The second compartment contains dry super-corroding Mg alloy powder or sintered powder (see U.S. Pat. No. 4,264,362), or powder or sintered powder prepared by grinding Mg and Fe powder (see U.S. Pat. No. 4,017,414). NaCl or KCl, for example, may be added to the second compartment. The barrier 4 is preferably made of a Mg alloy. Its corrosion rate depends on the temperature. Since the barrier 4 is electrically conductive, its temperature can be increased using the induction heater 32 as shown in FIG. 5. This will accelerate the barrier corrosion and, thus, will initiate the exothermic reaction between the chemicals in two compartments.

In another variation, the compartment containing NaCl solution also contains a Mg electrode with a corrosion potential lower than that of the Mg alloy barrier. This Mg electrode is in mechanical and electrical contact with the barrier 4, so it acts as a sacrificial anode immersed into the same electrolyte and preserves the barrier from corrosion. A dielectric "knife" 26 actuated by a sleeve as described above, separates the sacrificial anode from the Mg alloy barrier and, thus, the barrier corrosion rate increases.

Figure 4:
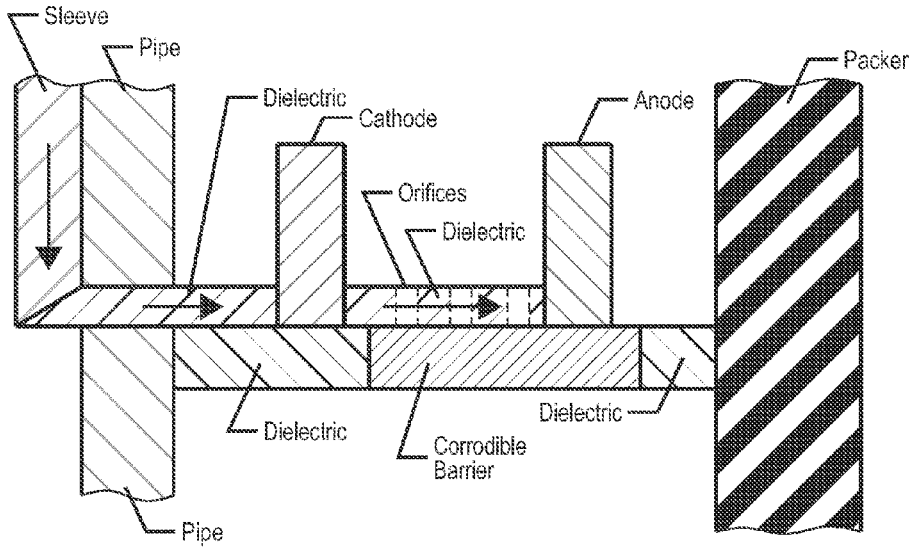
FIG. 4 illustrates the use of a sliding sleeve to move a protective anode out of contact with a barrier and bring a cathode into barrier contact to accelerate barrier degradation and the onset of the exothermic reaction.

In another variation, "knife" is composed of anodic and cathodic portions, which are separated by a dielectric. Initially, anodic part of the knife is in electrical and mechanical contact with the corrodible barrier. In this configuration, the barrier is preserved by the sacrificial anode. As the knife moves, cathodic part of the knife starts contacting the barrier while the anodic part is disconnected from the barrier. This will accelerate the corrosion of the barrier since it is now a sacrificial anode, as shown in FIG. 4.

In another version, the "knife" is cathodic with respect to the barrier. Initially it does not contact the barrier. Motion of the sleeve places the knife in contact with the barrier and the electrolyte. Now the barrier serves as a sacrificial anode.

Thus for a swelling material that acts as a packer the compartments 3 and 5 and the barrier 4 between them can be embedded in the element 2. The same goes for the use of swelling foam that acts as a self-conforming screen with the difference being that the foam is deliberately porous and the mandrel or pipe 1 is perforated.

Figure 2:
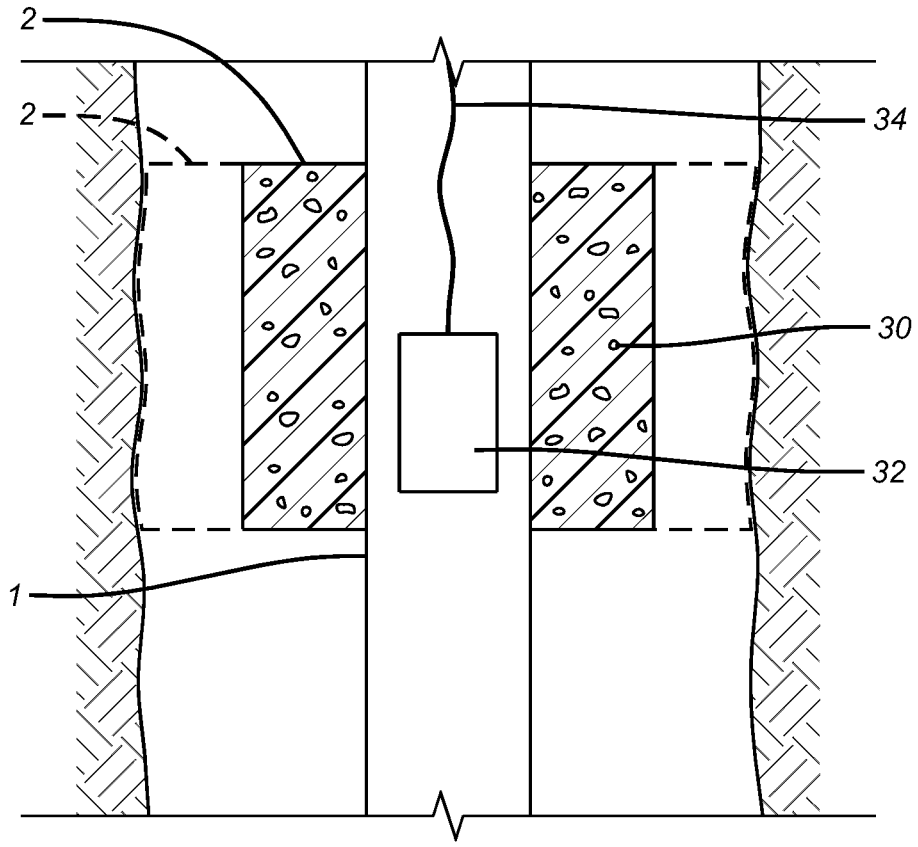
FIG. 2 is a schematic illustration of an alternative embodiment using ferromagnetic particles or the electrically conductive resins or polymers in the element and induction heating to accelerate swelling in the element.

Another alternative technique is schematically illustrated in FIG. 2. Here the swelling material 2 is impregnated or infused or otherwise produced to have a distribution of metal particles and preferably ferromagnetic particles, or particles made of electrically conductive resins or polymers, 30. The particles can be positioned in swelling foam by forcing the particles through the material 2 during the fabrication process. This can be done with flow through the foam and can be coordinated with compressing the foam to get its profile reduced for run in. An induction heater 32 is preferably run in on wireline 34 for a power source although local power and a slickline can also be used. The heater 32 can be radially articulated once in position so that its coils extend into close proximity of the tubular inside wall. While electromagnetic induction heating can also be used to locally increase the temperature of a ferromagnetic pipe 1 on which a packer or a totally conformable screen 2 is mounted, the preferred method is to use a dielectric mandrel 1 and, thus, to generate heat in the electrically conductive particles 30 distributed within the swelling element 2 directly. If the pipe 1 is metallic, it will increase the temperature of the packer or the screen 2 mounted on it and, thus, will stimulate deployment. Induction heating is the process of heating an electrically conducting object (usually a metal) by electromagnetic induction, where eddy currents are generated within the metal and resistance leads to Joule heating of the metal. In an induction downhole heater 32, a coil of insulated copper wire is placed inside the production pipe 1 opposing the packer or the conformable screen 2. An alternating electric current from the power source on the ground level delivered for example through wireline 34, is made to flow through the coil, which produces an oscillating magnetic field which creates heat in the base pipe in two different ways. Principally, it induces an electric current in the base pipe, which produces resistive heating proportional to the square of the current and to the electrical resistance of the pipe. Secondly, it also creates magnetic hysteresis losses in the base pipe due to its ferromagnetic nature. The first effect dominates as hysteresis losses typically account for less than ten percent of the total heat generated. Induction heaters are faster and more energy-efficient than other electrical heating devices. Moreover, they allow for instant control of heating energy. Since the induction heaters are more efficient when in the close proximity to the base pipe, it is suggested that the copper wire coils are mounted on an expandable, toward the pipe wall, wire line tool activated when it reaches the level of the packer or the screen.

If the mandrel 1 is dielectric, then the full effect of the heater 32 will go into the ferromagnetic particles 30 that are embedded in the element 2 and locally heat the element 2 from within. Preferably the particles will be randomly distributed throughout the element 2 so that the swelling process can be accelerated. Alternatively the mandrel 1 can be electrically conductive and the heating effect will take place from the mandrel 1 and from the ferromagnetic particles 30, if the field is not completely shielded by the pipe 1.

The ferromagnetic particles 30 are most simply incorporated into the element 2 at the time the element 2 is manufactured. In the case of a foam element 2 the ferromagnetic particles 30 can be in a solution that is pumped through the foam under pressure so as to embed the particles in the foam from a circulating process. The particles can also be incorporated into the manufacturing process for the element 2 rather than being added thereafter. Another more complex alternative is to add the particles to the element 2 after the element is at the desired subterranean location but monitoring the effectiveness of this mode of ferromagnetic particle addition can be an issue.

As an alternative to the metal or ferromagnetic particles the element 2 can be impregnated with electrically conductive resins or polymers also shown schematically as 30 and with induction heater 32 the result is the same as the heating effect described above using ferromagnetic particles.

The heater 32 can be moved in a single trip to accelerate swelling at a series of packers or screen sections. In the case of packers pressure can be applied to see if there is leakage or not past the packer after a predetermined time of heat application.

The above description is illustrative of the preferred embodiment and many modifications may be made by those skilled in the art without departing from the invention whose scope is to be determined from the literal and equivalent scope of the claims below.

We claim:

1. A method of acceleration of swelling of an element at a subterranean location, comprising:

locating the element at a desired location using a tubular string;

generating heat within said element using reactants stored in said element during said locating to accelerate swelling of said element;

moving said element to seal against a targeted surface from said swelling.

2. The method of claim 1, comprising:

separating said reactants until said element is located at the desired location.

3. The method of claim 2, comprising:

using a removable barrier to separate said reactants.

4. The method of claim 3, comprising:

using said barrier as a wall for adjacent sealed chambers that hold discrete reactants.

5. The method of claim 4, comprising:

allowing said reactants to mix by defeating said barrier.

6. The method of claim 5, comprising:

defeating said barrier by exposing it to differential pressure.

7. The method of claim 6, comprising:

exposing one of said chambers to annulus hydrostatic pressure or pressure added to the annulus to defeat said barrier.

8. The method of claim 5, comprising:

defeating said barrier with physical force.

9. The method of claim 8, comprising:

using an advancing cutter for defeating said barrier.

10. The method of claim 9, comprising:

driving said cutter directly or indirectly from within said tubular string.

11. The method of claim 10, comprising:

driving said cutter with a sleeve whose movement urges said cutter into said barrier using direct contact through a wall opening in said tubular string.

12. The method of claim 10, comprising:

creating a field within said tubular string that provides the energy to drive said cutter into said barrier without a wall opening in the tubular string.

13. The method of claim 5, comprising:

defeating said barrier by chemical reaction or dissolving.

14. The method of claim 13, comprising:

making one of said reactants corrosive to said barrier.

15. The method of claim 14, comprising:

making said barrier of an electrically conductive material;

heating said barrier with an induction heater to accelerate barrier corrosion.

16. The method of claim 5, comprising:

defeating said barrier after a predetermined time measured on a timer.

17. The method of claim 5, comprising:

defeating said barrier with heat provided by well fluids adjacent said element.

18. The method of claim 4, comprising:
locating said chambers wholly within said element.
19. The method of claim 1, comprising:
locating a catalyst in said element.
20. The method of claim 19, comprising:
locating a catalyst with at least one said reactant.
21. The method of claim 1, comprising:
making said element impervious for packer service or porous for screen service.
22. A method of acceleration of swelling of an element at a subterranean location, comprising:
locating the element at the desired location using a tubular string;
generating heat within said element using reactants stored in said element;
separating said reactants until said element is located at the desired location;
using a removable barrier to separate said reactants;
using said barrier as a wall for adjacent sealed chambers that hold discrete reactants;
allowing said reactants to mix by defeating said barrier;
defeating said barrier by chemical reaction or dissolving;
making said barrier a sacrificial member of a galvanic pair to defeat said barrier.
23. A method of acceleration of swelling of an element at a subterranean location, comprising:
locating the element at the desired location using a tubular string;
generating heat within said element using reactants stored in said element;
separating said reactants until said element is located at the desired location;
using a removable barrier to separate said reactants;
using said barrier as a wall for adjacent sealed chambers that hold discrete reactants;
allowing said reactants to mix by defeating said barrier;
defeating said barrier by chemical reaction or dissolving;
making one of said reactants corrosive to said barrier;
providing a sacrificial anode in contact with said barrier to initially protect said barrier from corrosion;
separating said anode from said barrier to accelerate barrier corrosion.
24. The method of claim 23, comprising:
moving a cathodic material against the barrier after said separating to accelerate corrosion of said barrier.
25. A method of acceleration of swelling of an element at a subterranean location, comprising:
locating the element at the desired location using a tubular string;
generating heat within said element using reactants stored in said element;
separating said reactants until said element is located at the desired location;
using a removable barrier to separate said reactants;
using said barrier as a wall for adjacent sealed chambers that hold discrete reactants;
allowing said reactants to mix by defeating said barrier;
defeating said barrier by chemical reaction or dissolving;
making one of said reactants corrosive to said barrier;
providing a cathodic material in one of said compartments;
moving the cathodic material against said barrier to accelerate corrosion of said barrier.

* * * * *